US011135606B1

(12) United States Patent
McGregor, II et al.

(10) Patent No.: US 11,135,606 B1
(45) Date of Patent: Oct. 5, 2021

(54) FLUID APPLICATOR ASSEMBLIES

(71) Applicants: George Merritt McGregor, II, DeRidder, LA (US); Craig Patrick Leach, DeRidder, LA (US)

(72) Inventors: George Merritt McGregor, II, DeRidder, LA (US); Craig Patrick Leach, DeRidder, LA (US)

( * ) Notice: Subject to any disclaimer, the term of this patent is extended or adjusted under 35 U.S.C. 154(b) by 0 days.

(21) Appl. No.: 17/173,408

(22) Filed: Feb. 11, 2021

Related U.S. Application Data

(60) Provisional application No. 62/972,927, filed on Feb. 11, 2020.

(51) Int. Cl.
*B05B 7/24* (2006.01)
*B05B 7/30* (2006.01)

(52) U.S. Cl.
CPC ..... *B05B 7/2491* (2013.01); *B05B 7/2418* (2013.01); *B05B 7/2435* (2013.01); *B05B 7/30* (2013.01); *B05B 7/2408* (2013.01)

(58) Field of Classification Search
CPC ... B05B 7/2491; B05B 7/2435; B05B 7/2418; B05B 7/2408; B05B 7/30
See application file for complete search history.

(56) References Cited

U.S. PATENT DOCUMENTS 1,769,428 A * 7/1930 Gatchet ..... B01F 5/0496 422/282
5,226,567 A * 7/1993 Sansalone ..... A01M 9/0092 222/195
5,240,186 A 8/1993 Dobbins et al.
6,409,097 B1 6/2002 McCauley
6,837,447 B1 * 1/2005 Clark ..... A01M 7/0003 239/142
6,889,773 B2 * 5/2005 Hanratty ..... A62C 5/02 169/14
7,065,944 B1 6/2006 Steele
7,559,490 B2 7/2009 Rappin
9,414,580 B2 8/2016 Franks et al.
2013/0181064 A1 * 7/2013 Sardo ..... B05B 7/30 239/69
2016/0345488 A1 12/2016 Reitzel

* cited by examiner

*Primary Examiner* — Qingzhang Zhou
(74) *Attorney, Agent, or Firm* — R. Keith Harrison

(57) ABSTRACT

Fluid applicator assemblies which can be attached to or fabricated integrally with a blowing apparatus such as a leaf blower as a source of flowing air to atomize and eject atomized liquids into spaces and/or onto surfaces may include a nozzle having a nozzle body. At least one air flow cavity may be provided in the nozzle body. An air inlet slot may extend through the nozzle body and may be disposed in fluid communication with the at least one air flow cavity. A fluid ejection portion may be carried by the nozzle body. The fluid ejection portion may include an ejection head support extending from the nozzle body. A fluid ejection head may be carried by the ejection head support. A tube opening may extend through the fluid ejection portion. A fluid ejection slot may be provided in the fluid ejection head and disposed in fluid communication with the tube opening. A liquid container may be disposed in fluid communication with the fluid ejection slot through the tube opening. Other embodiments of the fluid applicator assemblies are disclosed.

14 Claims, 12 Drawing Sheets

FLUID APPLICATOR ASSEMBLIES

CROSS-REFERENCE TO RELATED APPLICATIONS

This application claims the benefit of U.S. provisional application No. 62/972,927, filed Feb. 11, 2020 and entitled FLUID APPLICATOR ASSEMBLIES, which provisional application is hereby incorporated by reference herein in its entirety.

FIELD

Illustrative embodiments of the disclosure are generally directed to devices for atomizing and ejecting atomized liquids. More particularly, illustrative embodiments of the disclosure are directed to fluid applicator assemblies which can be attached to or fabricated integrally with a blowing apparatus such as a leaf blower as a source of flowing air to atomize and eject atomized liquids into spaces and/or onto surfaces.

SUMMARY

Illustrative embodiments of the disclosure are generally directed to fluid applicator assemblies which can be attached to or fabricated integrally with a blowing apparatus such as a leaf blower as a source of flowing air to atomize and eject atomized liquids into spaces and/or onto surfaces. An illustrative embodiment of the fluid applicator assemblies may include a nozzle having a nozzle body. At least one air flow cavity may be provided in the nozzle body. An air inlet slot may extend through the nozzle body and may be disposed in fluid communication with the at least one air flow cavity. A fluid ejection portion may be carried by the nozzle body. The fluid ejection portion may include an ejection head support extending from the nozzle body. A fluid ejection head may be carried by the ejection head support. A tube opening may extend through the fluid ejection portion. A fluid ejection slot may be provided in the fluid ejection head and disposed in fluid communication with the tube opening. A liquid container may be disposed in fluid communication with the fluid ejection slot through the tube opening.

Illustrative embodiments of the disclosure are further generally directed to fluid applicator assemblies for a blowing apparatus having a motor housing and a blower tube having a blower tube interior extending from the motor housing. An illustrative embodiment of the fluid applicator assemblies may include a fluid tank having a fluid tank wall configured for attachment to the blower tube of the blowing apparatus and a fluid tank interior configured to be formed by and between the blower tube and the fluid tank wall. An atomizer assembly may be disposed in the fluid tank interior of the fluid tank and configured to be disposed in the blower tube interior of the blower tube. The atomizer assembly may include an atomizer assembly block. At least one fluid passage may be provided in the atomizer assembly block. The at least one fluid passage may be disposed in fluid communication with the fluid tank interior of the fluid tank. At least one atomizing impeller may be carried by the atomizer assembly block. The at least one fluid passage may discharge in fluid communication with the at least one atomizing impeller.

BRIEF DESCRIPTION OF THE DRAWINGS

Illustrative embodiments of the disclosure will now be described, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 8:
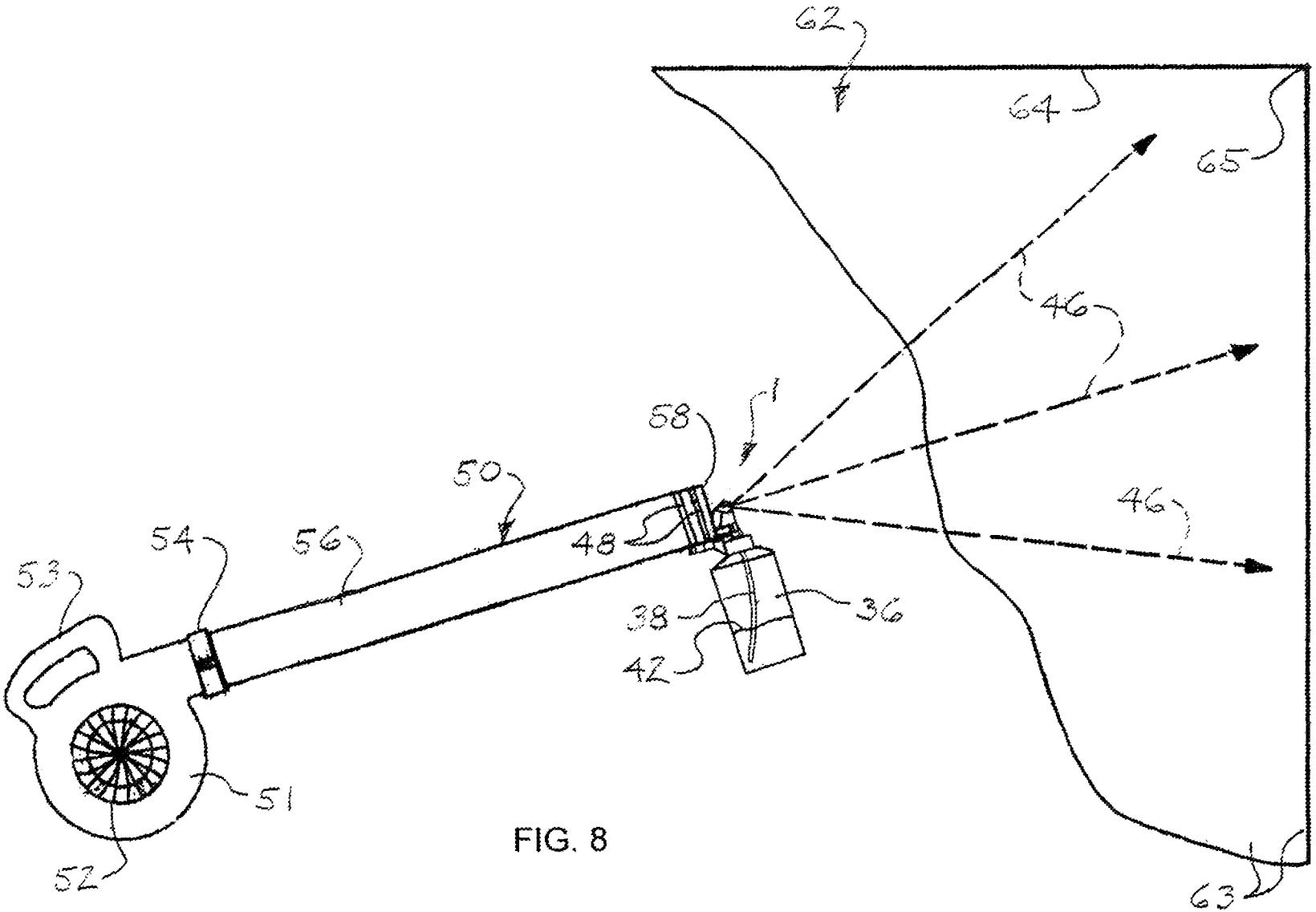
FIG. 8 is a side view of the blowing apparatus, more particularly illustrating ejection of atomized liquid droplets onto walls, a ceiling and a corner of a room in typical application of the assembly.

Referring initially to FIG. 8 of the drawings, an illustrative embodiment of the fluid applicator assemblies, hereinafter assembly, is generally indicated by reference numeral 1. As will be hereinafter described, the assembly 1 may be configured for attachment to or fabricated integrally with a blowing apparatus, commonly known in the art as a leaf blower 50, to atomize a liquid 42 and eject the resulting atomized liquid droplets 46 into spaces and/or onto surfaces. For example and without limitation, in some applications, the assembly 1 may atomize a liquid 42 and eject the atomized liquid droplets 46 which contain at least one pesticide, insect repellant, paint, sealant or other substance onto one or more walls 63 or a ceiling 64 and/or into a corner 65 in a room 62 of a home, office or other structure. The blowing apparatus 50 may have a standard or conventional design with a motor housing 51 which encloses a motor (not illustrated) and a vent 52 and a handle 53 on the motor housing 51. A fan (not illustrated) in the motor housing 51 may be drivingly engaged by the motor. A trigger (not illustrated) may be provided on the handle 53 to operate the motor. An elongated blower tube 56 may extend from the motor housing 51. The blower tube 56 may have a blower tube discharge end 58 opposite the motor housing 51 and a blower tube interior 57 (FIG. 9) and which extends from the motor housing 51 to the blower tube discharge end 58. The blower tube 56 may be releasably attached to the motor housing 51 via a tube clamp 54. The assembly 1 may be quickly and easily attached to and removed from the blower tube discharge end 58 without structural modification to the blower tube 56, typically in a manner which will be hereinafter described.

Figure 2:
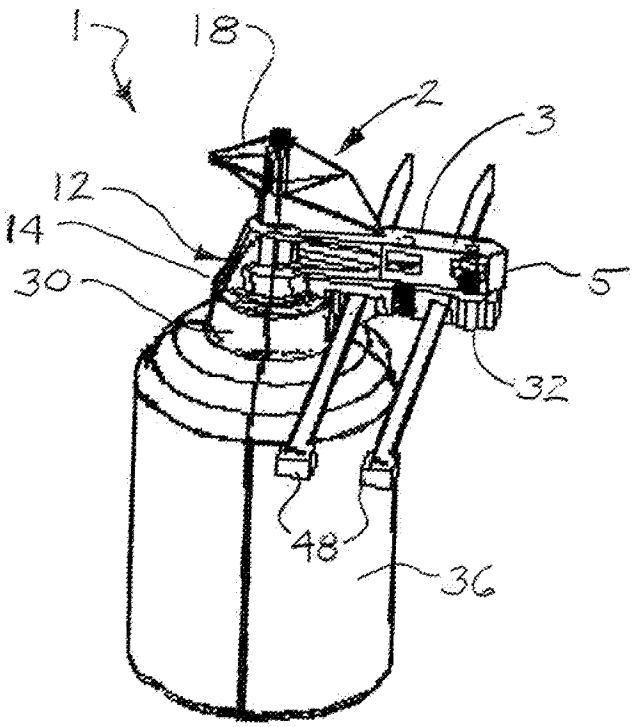
FIG. 2 is a side perspective view of the illustrative fluid applicator assembly illustrated in FIG. 1, removed from the leaf blower (not illustrated)
Figure 3:
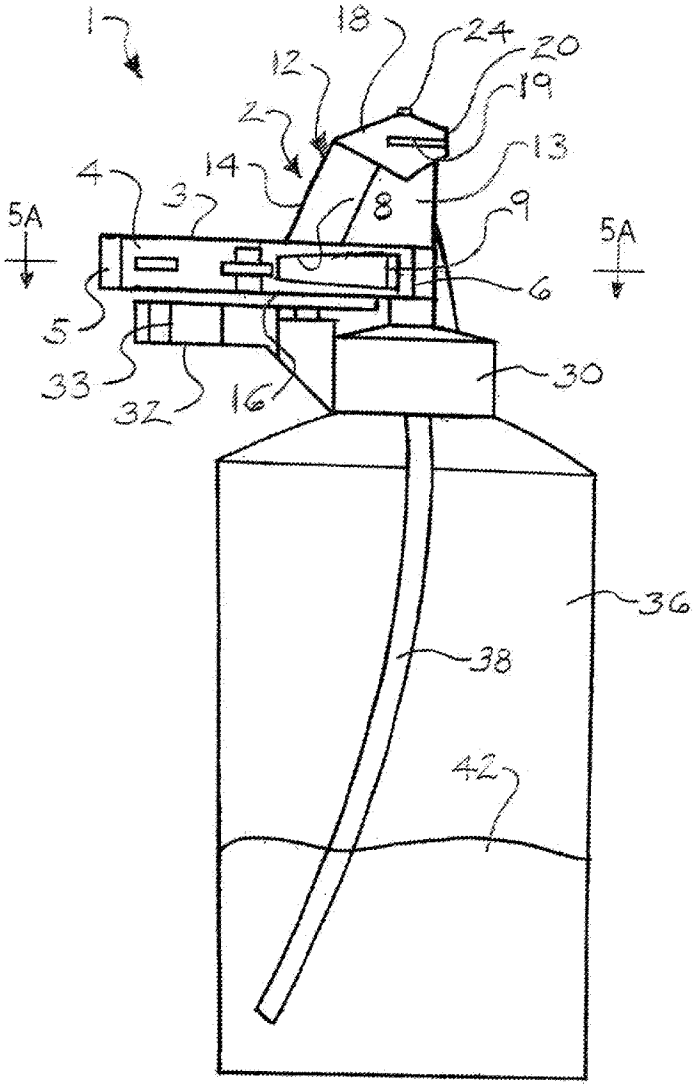
FIG. 3 is aside view of the illustrative fluid applicator assembly with a supply of liquid in the liquid container of the assembly.

Referring next to FIG. 1-12 of the drawings, the assembly 1 may include a nozzle 2. As illustrated in FIGS. 2-5A, the nozzle 2 may include an elongated nozzle body 3. The nozzle body 3 may have a rear nozzle body end 5 and a front nozzle body end 6 (FIG. 3). A pair of opposite side nozzle body surfaces 4 may extend from the rear nozzle body end 5 to the front nozzle body end 6. The side nozzle body surfaces 4 may taper and join at the rear nozzle body end 5.

Figure 5:
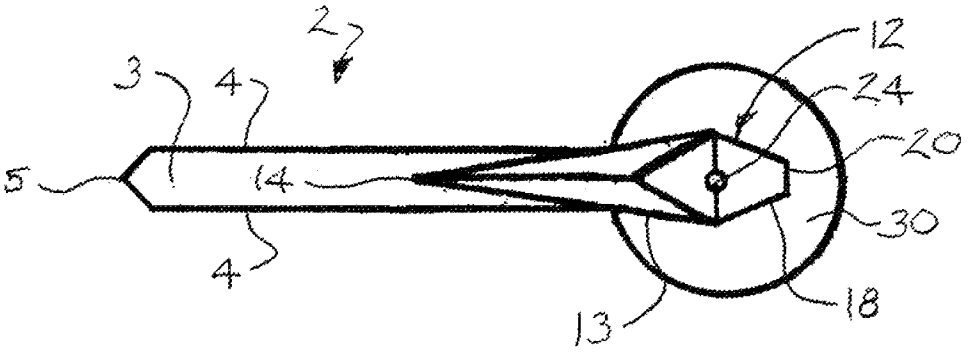
FIG. 5 is a top view of a typical nozzle of the illustrative fluid applicator assembly.
Figure 5A:
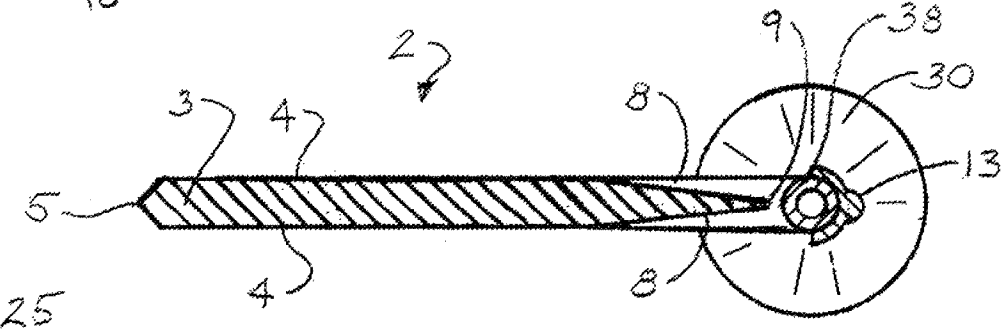
FIG. 5A is a sectional view, taken along section lines 5A-5A in FIG. 3, of a typical nozzle body of the nozzle.

At least one, and typically, a pair of air flow cavities 8 (one of which is illustrated in FIG. 3) may extend into at least one or the respective side nozzle body surfaces 4 of the nozzle body 3. As illustrated in FIG. 5A, the air flow cavities 8 may angle inwardly toward each other toward the front nozzle body end 6 (FIG. 3). The front or terminal recessed ends of the respective air flow cavities 8 may converge at an air inlet slot 9 which extends transversely through the nozzle body 3.

The nozzle 2 may include a fluid ejection portion 12. The fluid ejection portion 12 may include an ejection head support 13 which extends forwardly and upwardly from the nozzle body 3. The ejection head support 13 may have a sloped or angled and tapered rear edge 14. A fluid ejection head 18 may be supported by the ejection head support 13. As illustrated in FIG. 3, the fluid ejection head 18 may be generally diamond-shaped in side view. The fluid ejection head 18 may have a front head surface 20 which is opposite the tapered rear edge 14.

Figure 12:
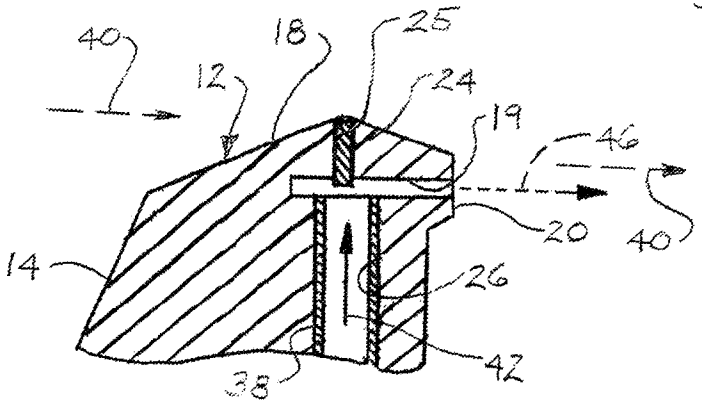
FIG. 12 is an enlarged sectional view of the fluid ejection portion of the nozzle on the fluid applicator assembly, more particularly illustrating typical flow of liquid through and ejection of atomized liquid droplets from the fluid ejection portion as air flows around and over the fluid ejection portion.

As illustrated in FIG. 12, a fluid ejection conduit, such as a fluid ejection slot 19, for example and without limitation, may extend generally horizontally and rearwardly from the front head surface 20 into the fluid ejection head 18. An adjuster screw opening 25 may extend vertically into the fluid ejection head 18. The lower end of the adjuster screw opening 25 may communicate with the fluid ejection slot 19. A spray control adjuster screw 24 may be threaded in the adjuster screw opening 25. Accordingly, the spray control adjuster screw 24 can be threaded in the adjuster screw opening 25 until the spray control adjuster screw 24 extends a selected distance into the fluid ejection slot 19 for purposes which will be hereinafter described.

A tube opening 26 may extend vertically through the fluid ejection head 18. The upper end of the tube opening 26 may terminate in fluid communication with the fluid ejection slot 19 for purposes which will be hereinafter described. As further illustrated in FIG. 12, the tube opening 26 may align or register with the adjuster screw opening 25.

Figure 9:
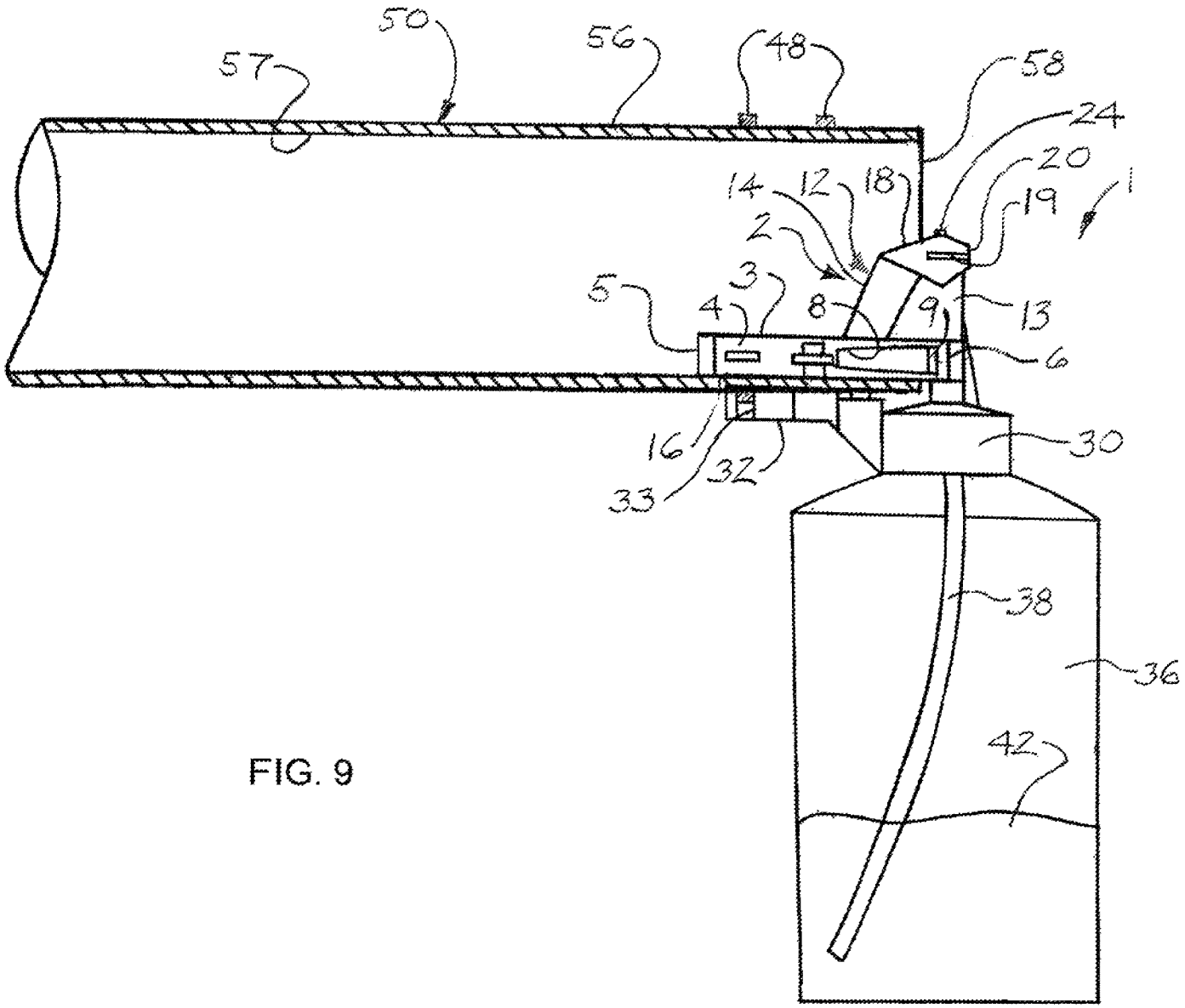
FIG. 9 is a longitudinal sectional view of a portion of the blower tube of the blowing apparatus, with the illustrative fluid applicator assembly mounted in place on the blower tube in typical application of the assembly.
Figure 10:
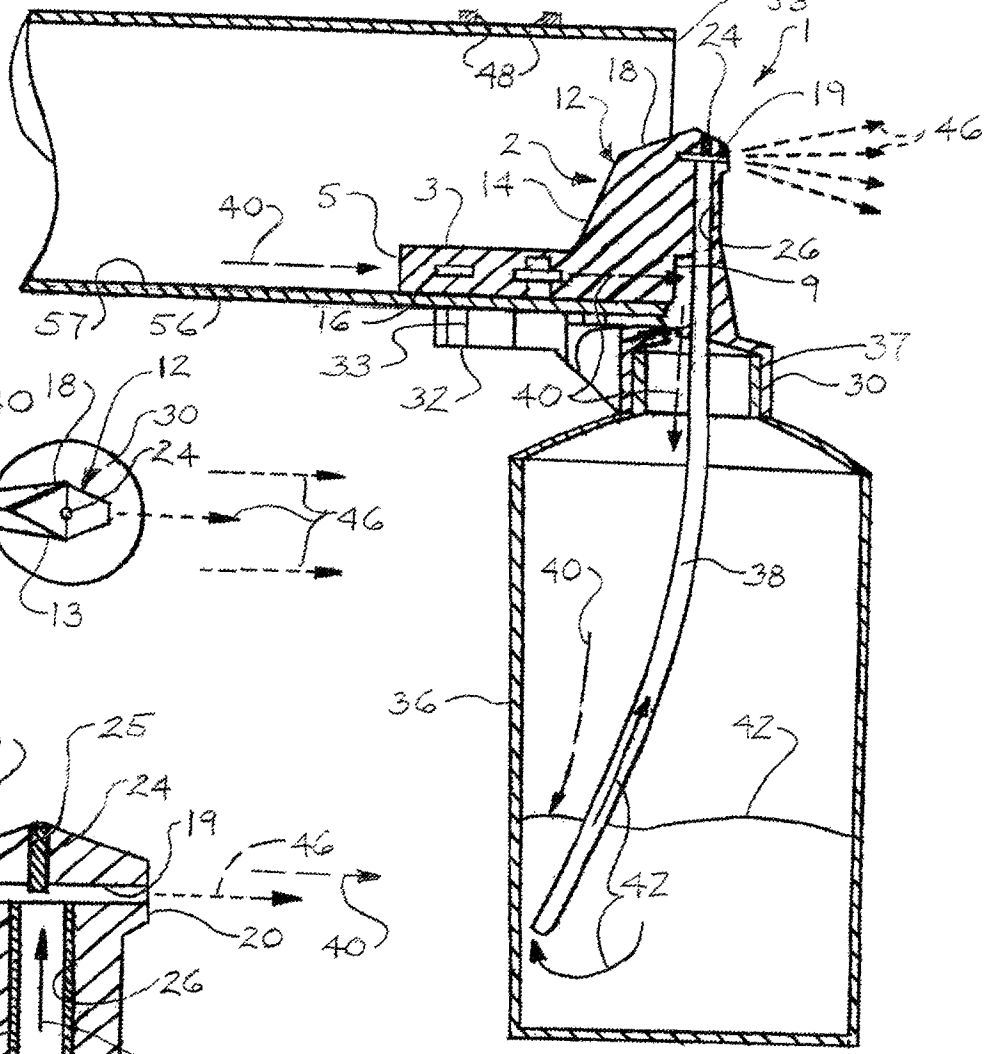
FIG. 10 is a sectional view of the blower tube and the fluid applicator assembly, more particularly illustrating typical flow of air and liquid through the assembly and ejection of atomized liquid droplets from the assembly in typical application of the assembly.

A container cap 30 may extend downwardly from the fluid ejection head 18 of the fluid ejection portion 12. The container cap 30 may facilitate attachment of the nozzle 2 to a liquid container 36 which contains a supply of the liquid 42 to be atomized in operation of the assembly 1, which will be hereinafter described. As illustrated in FIGS. 9 and 10, the container cap 30 may be sized and configured for attachment to a container neck 37 (FIG. 10) on the liquid container 36. As illustrated in FIG. 10, the air inlet slot 9 in the nozzle body 3 of the nozzle 2 may communicate with the interior of the liquid container 36 through the container cap 30 and with the tube opening 26 in the fluid ejection portion 12. In some embodiments, the container cap 30 may have interior cap threads (not illustrated) which mesh with companion exterior container neck threads (not illustrated) on the container neck 37 to detachably attach the nozzle 2 to the liquid container 36.

Figure 4:
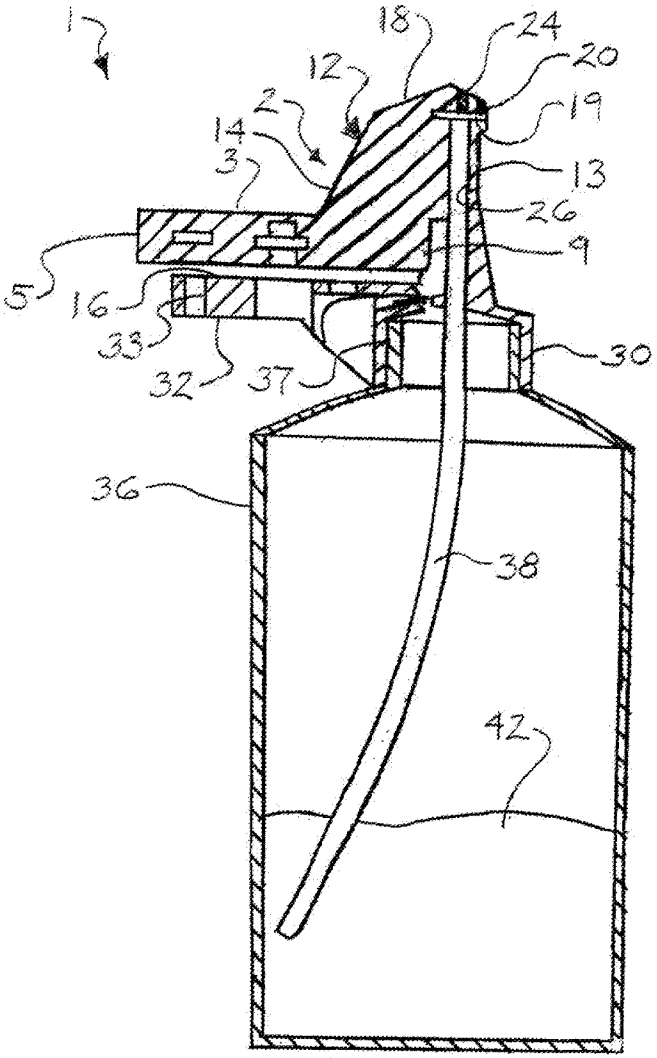
FIG. 4 is a longitudinal sectional view of the illustrative fluid applicator assembly.
Figure 6:
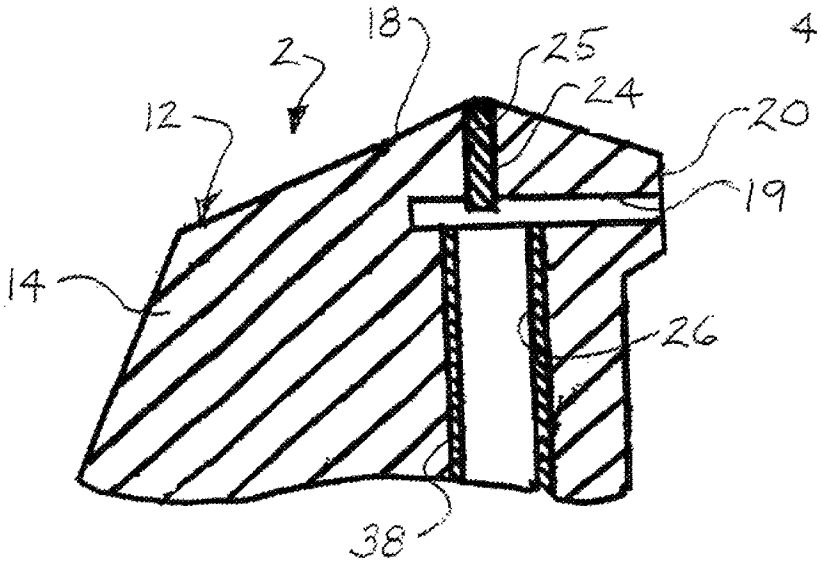
FIG. 6 is an enlarged sectional view of the fluid ejection portion of the nozzle on the illustrative fluid applicator assembly.
Figure 7:
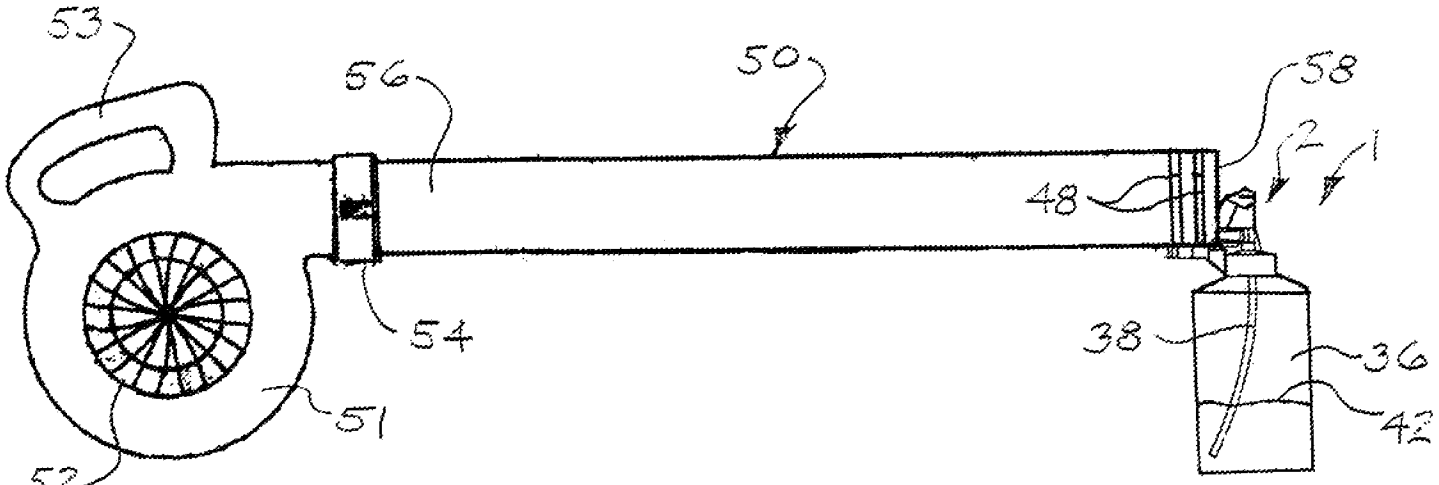
FIG. 7 is a side view of a typical blowing apparatus with the illustrative fluid applicator assembly deployed in place on the blower tube discharge end of the blower tube on the blower in typical application of the assembly.
Figure 11:
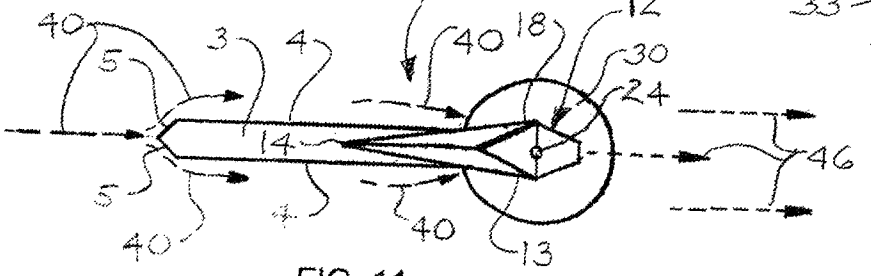
FIG. 11 is a top view of the nozzle of the fluid applicator assembly, more particularly illustrating typical flow of air on opposite sides of the nozzle and ejection of atomized droplets from the nozzle in typical application of the assembly.

A liquid tubing 38 may extend upwardly from the interior of the liquid container 36 through the container neck 37. As illustrated in FIGS. 4, 5A and 6, the liquid tubing 38 may further extend upwardly past the air inlet slot 9 through the tube opening 26 in the fluid ejection head 18 of the fluid ejection portion 12 of the nozzle 2. The liquid tubing 38 may be glued and/or otherwise attached to the interior surface of the tube opening 26 or may be friction-fitted into the tube opening 26. As illustrated in FIG. 6, the upper end of the liquid tubing 38 may terminate at the fluid ejection slot 19 in the fluid ejection head 18. Accordingly, in typical application of the assembly 1, which will be hereinafter described, air 40 which is generated by the motor (not illustrated) of the blowing apparatus 50 and flows through the blower tube interior 57 of the blower tube 56 may flow initially along both of the side nozzle body surfaces 4 of the nozzle body 3, as illustrated in FIG. 11, and then into the respective air flow cavities 8 and the air inlet slot 9, respectively, of the nozzle 2. The air 40 may flow downwardly from the air inlet slot 9 through the container cap 30 and into the interior of the liquid container 36, respectively. As illustrated in FIG. 10, the air 40 in the liquid container 36 may apply downward surface pressure against the liquid 42, causing a portion of the liquid 42 to travel from the liquid container 36 and upwardly through the liquid tubing 38 and into the fluid ejection slot 19 in the fluid ejection head 18. As a portion of the air in the blower tube interior 57 flows past the fluid ejection portion 12 of the nozzle 2, the flowing air 40 may create negative pressure which aspirates and pulls or ejects the liquid 42 from the fluid ejection slot 19 as the atomized liquid droplets 46 (FIGS. 10-13), as further illustrated in FIGS. 10-12 and will be hereinafter further described.

Figure 1:
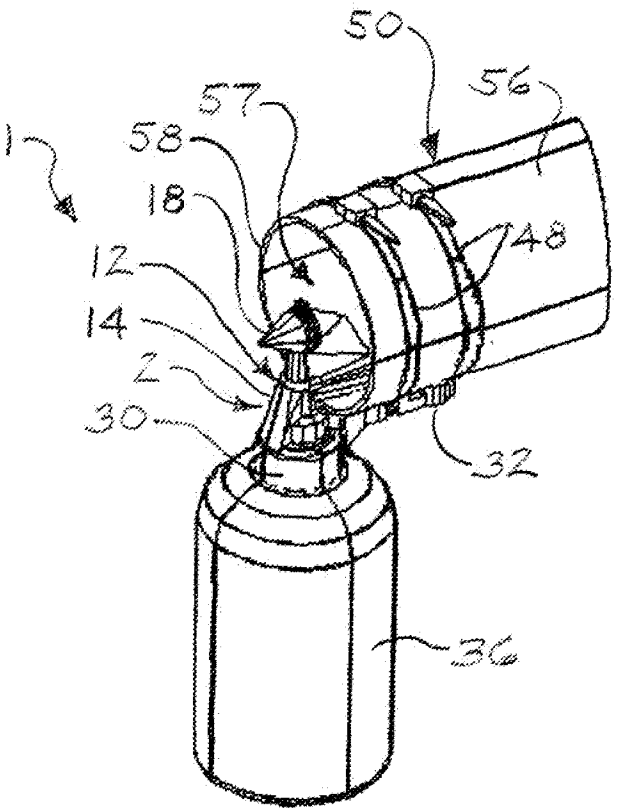
FIG. 1 is a front perspective view of an illustrative embodiment of the fluid applicator assemblies, fitted on the discharge end of a blower tube (partially in section) on a leaf blower in typical application of the assembly.

As further illustrated in FIGS. 3 and 4, at least one nozzle mount flange 32 may extend rearwardly from the container cap 30 in parallel, spaced-apart relationship to the nozzle body 3. In some embodiments, the nozzle mount flange 32 may be configured to facilitate attachment of the nozzle 2 to the blower tube 56 of the blowing apparatus 50. Accordingly, an elongated blower tube slot 16 may extend between the nozzle body 3 and the nozzle mount flange 32. The blower tube slot 16 may be suitably sized and configured to receive and accommodate the edge of the blower tube 56 at the blower tube discharge end 58 of the blower tube 56. As illustrated in FIGS. 1 and 2, at least one clamp tie 48 may facilitate attachment of the nozzle mount flange 32 to the blower tube 56. Each clamp tie 48 may extend through a corresponding nozzle mount flange opening 33 in the nozzle mount flange 32 and may encircle the blower tube 56 to mount the nozzle 2 to the blower tube 56 with the fluid ejection head 18 of the fluid ejection portion 12 of the nozzle 2 disposed in the blower tube interior 57 at the blower tube discharge end 58 of the blower tube 56, as illustrated in FIG. 9. In other embodiments, the nozzle 2 may be fabricated as an integral part with the blower tube 56 of the blowing apparatus 50 according to the knowledge of those skilled in the art.

In typical application of the assembly 1, a selected liquid 42 which is to be atomized and ejected as the atomized liquid droplets 46 may be placed in the liquid container 36. The liquid 42 may include any type of liquid which is to be atomized and dispersed into fine atomized liquid droplets 46 into one or more spaces or onto one or more surfaces. For example and without limitation, as illustrated in FIG. 8, in some applications, the liquid 42 may include pesticide or insect repellant which is to be applied as the atomized liquid droplets 46 onto one or more walls 63 or a ceiling 64 and/or into a corner 65 in a room 62 of a home, office or other structure. In other applications, the liquid 42 may include paint, a sealant or other liquid.

The nozzle 2 may be attached to the liquid container 36 by attaching the container cap 30 on the nozzle 2 to the container neck 37 on the liquid container 36. For example and without limitation, in some embodiments, interior cap threads (not illustrated) in the container cap 30 may be engaged with companion exterior neck threads (not illustrated) on the container neck 37. As the container cap 30 is lowered in place onto the container neck 37, the liquid tubing 38 may insert through the container neck 37 into the liquid 42 in the liquid container 36.

In some applications, the nozzle 2 may next be attached to the blower tube 56 of the blowing apparatus 50. This may be accomplished by initially inserting the lower edge portion of the blower tube discharge end 58 of the blower tube 56 into the blower tube slot 16 between the nozzle body 3 and the nozzle mount flange 32 on the nozzle 2. The clamp tie or ties 48 may be extended through the respective nozzle mount flange opening or openings 33 in the nozzle mount flange 32 and extended around the blower tube 56 and secured. Accordingly, as illustrated in FIG. 9, the fluid ejection head 18 on the nozzle 2 may be disposed partially within the blower tube interior 57 of the blower tube 56 with the front head surface 20 of the fluid ejection head 18 typically in front of the blower tube discharge end 58 of the blower tube 56. In other applications, the nozzle body 3 may be cast, molded or otherwise fabricated integrally with the blower tube 56 of the blowing apparatus 50 according to the knowledge of those skilled in the art.

An operator (not illustrated) may next grasp and aim the blowing apparatus 50 at the target space into which the atomized liquid droplets 46 are to be ejected and/or the target surface or surfaces onto which the atomized liquid droplets 46 are to be applied, as illustrated in FIG. 8. The operator may then operate the motor of the blowing apparatus 50 such that the motor generates and blows air 40 from the motor housing 51 through the blower tube interior 57 toward the blower tube discharge end 58. As the air 40 reaches the nozzle 2 of the apparatus 1, as illustrated in FIGS. 10 and 11, the typically tapered rear nozzle body end 5 of the nozzle body 3 may divide the stream of air 40 into separate air streams which flow initially along the respective side nozzle body surfaces 4 of the nozzle body 3 and then into the respective air flow cavities 8 (FIG. 5A) and the air inlet slot 9, respectively, of the nozzle 2. As illustrated in FIG. 10, from the air inlet slot 9, the air 40 may flow downwardly through the container cap 30 and into the interior of the liquid container 36, respectively. The air 40 in the liquid container 36 may apply downward surface pressure against the liquid 42 such that a portion of the liquid 42 flows from the liquid container 36 upwardly through the liquid tubing 38. As illustrated in FIG. 12, the liquid 42 may discharge from the liquid tubing 38 into the fluid ejection slot 19 in the fluid ejection head 18.

As illustrated in FIG. 11, a second portion of the air 40 in the blower tube interior 57 may bypass the air flow cavities 8 and flow past the fluid ejection portion 12 of the nozzle 2. Accordingly, the typically tapered rear edge 14 of the ejection head support 13 may divide the second portion of the air 40 into separate air streams which flow on opposite sides of the ejection head support 13 and fluid ejection head 18. The flowing air 40 may create negative pressure which aspirates and pulls or ejects the liquid 42 from the fluid ejection slot 19 in the fluid ejection head 18. As it is ejected from the fluid ejection slot 19, the liquid 42 is atomized. The atomized liquid droplets 46 may travel with the flowing air 40 into the target space or onto or against the target surfaces toward which the blowing apparatus 50 is aimed. The atomized liquid droplets 46 may uniformly fill the target space and/or coat and dry on the target surface or surfaces, thus forming uniform dispersal of the liquid 42 in the target space and/or coverage of the liquid 42 on the target surface or surfaces.

Referring again to FIG. 12 of the drawings, it will be appreciated by those skilled in the art that position of the spray control adjuster screw 24 in the adjuster screw opening 25 can be varied to control the extent to which the spray control adjuster screw 24 extends into the fluid ejection slot 19. This expedient may vary the width of the spray pattern of the atomized liquid droplets 46 which are ejected from the fluid ejection slot 19. Accordingly, a greater extension of the spray control adjuster screw 24 into the adjuster screw opening 25 may facilitate a wider dispersal and a correspondingly broader spray pattern and lesser concentration of the atomized liquid droplets 46 within a larger area of the target space or surface. Conversely, a lesser extension of the spray control adjuster screw 24 in the adjuster screw opening 25 may facilitate a narrower dispersal and a correspondingly narrower spray pattern and greater concentration of the atomized liquid droplets 46 within a smaller area of the target space or surface.

Figure 13:
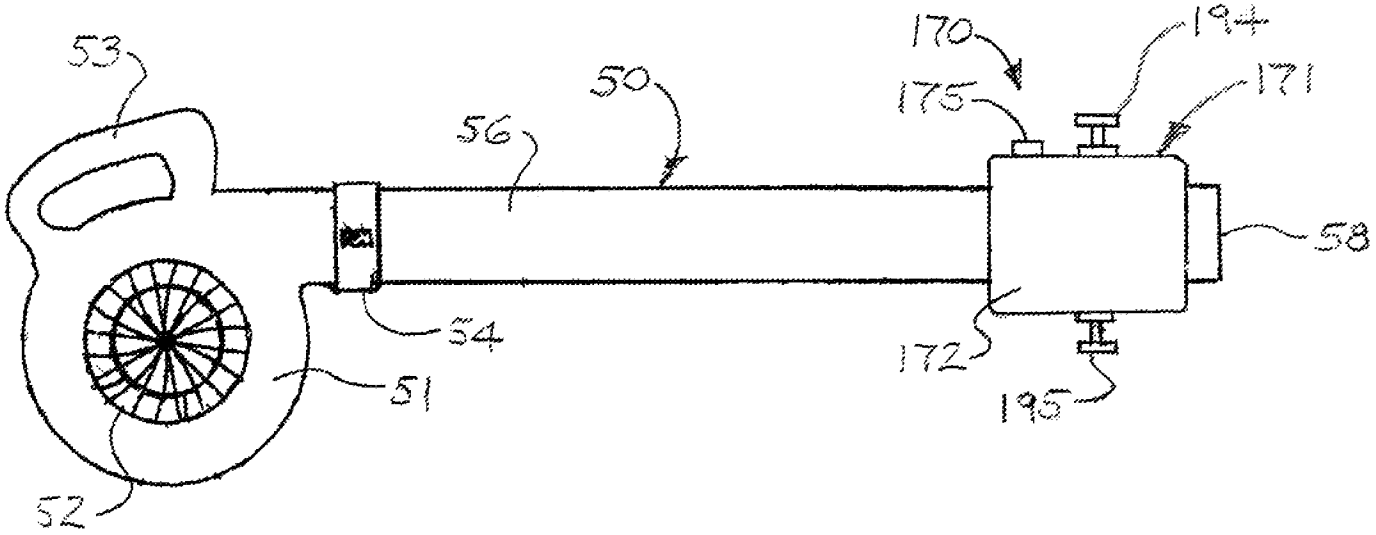
FIG. 13 is a side view of a typical blowing apparatus with an alternative illustrative embodiment of the fluid applicator assembly built into the blower tube of the leaf blower.
Figure 14:
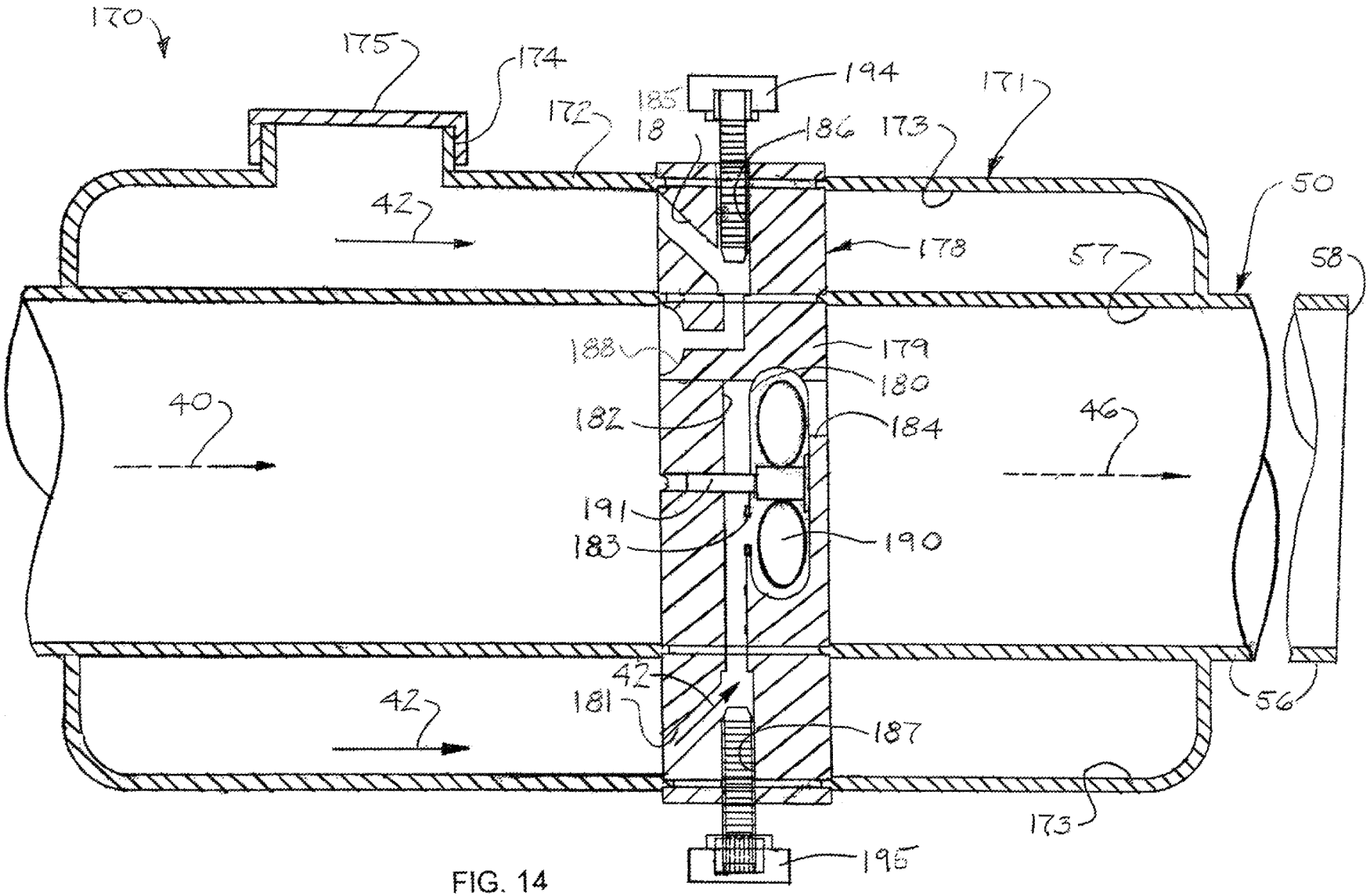
FIG. 14 is a longitudinal sectional view of the fluid applicator assembly of FIG. 13, more particularly illustrating typical flow of air and liquid through and ejection of atomized liquid droplets from the assembly in typical application of the assembly.

Referring next to FIGS. 13 and 14 of the drawings, an alternative illustrative embodiment of the fluid applicator assemblies is generally indicated by reference numeral 170. The assembly 170 may be built into the blowing apparatus 50 and may include a fluid lank 171. The fluid tank 171 may include a fluid tank wall 172 which extends from the exterior surface of the blower tube 56 of the blowing apparatus 50. In some embodiments, the fluid tank wall 172 of the fluid tank 171 may be fabricated in one piece with the blower tube 56 of the blowing apparatus 50 according to the knowledge of those skilled in the art. In other embodiments, the fluid tank wall 172 of the fluid tank 171 may be welded and/or otherwise attached to the blower tube 56 such as by using brackets and/or mechanical fasteners which are suitable for the purpose.

The fluid tank wall 172 of the fluid tank 171 may encircle and may be concentric with the blowing apparatus 50. Accordingly, as illustrated in FIG. 14, an annular fluid tank interior 173 may be formed by and between the exterior surface of the blower tube 56 and the interior surface of the fluid tank wall 172. In typical application of the fluid applicator assembly 170, which will be hereinafter described, the fluid tank interior 173 may contain a supply of the liquid 42 which is to be atomized. At least one fluid fill neck 174 may extend from the fluid tank wall 172. A fill neck cap 175 may be detachably attached to the fluid fill neck 174. The liquid 42 may be placed in the fluid tank interior 173 through the fluid fill neck 174.

An atomizer assembly 178 may be disposed in the blower tube interior 57 of the blowing apparatus 50 and the fluid tank interior 173 of the fluid tank 171. The atomizer assembly 178 may facilitate contact between the liquid 42 to be atomized and the air 40 flowing through the blower tube interior 57 of the blower tube 56. In some embodiments, the atomizer assembly 178 may include an atomizer assembly block 179. The atomizer assembly block 179 may be sealingly mounted to the fluid tank wall 172 of the fluid tank 171 and the blower tube 56 of the blowing apparatus 50 according to the knowledge of those skilled in the art. The blower tube 56 of the blowing apparatus 50 and the fluid tank wall 172 of the fluid tank 171 may include slots or openings and seals (not numbered) which are suitable for this purpose.

The atomizer assembly block 179 may have at least one interior impeller cavity 180. At least one atomizing impeller 190 may be mounted for rotation in the impeller cavity 180 typically on an impeller shaft 191. At least one fluid flow passage 181 may extend into the atomizer assembly block 179. The fluid flow passage 181 may be disposed in fluid communication with the fluid tank interior 173 of the fluid tank 171. An interior passage 182 in the atomizer assembly block 179 may be disposed in fluid communication with the fluid flow passage 181. The impeller cavity 180 may be disposed in fluid communication with the interior passage 182 typically through an atomizing impeller port 183. An atomizer outlet port 184 may establish fluid communication between the impeller cavity 180 and the blower tube interior 57 of the blowing apparatus 50 at the downstream surface of the atomizer assembly block 179.

At least one fluid flow valve opening 187 may extend into the atomizer assembly block 179 of the atomizer assembly 178. The fluid flow passage 181 may be disposed in fluid communication with the fluid flow valve opening 187. A fluid flow valve 195 may be threaded into the fluid flow valve opening 187. Accordingly, the fluid flow valve 195 can be bidirectionally threaded in the fluid flow valve opening 187 to vary the size or width of the opening between the fluid flow passage 181 and the interior passage 182 to correspondingly control the rate of flow of the liquid 42 as the liquid 42 flows from the fluid tank interior 173 of the fluid tank 171 through the fluid flow passage 181 and into the interior passage 182 and the impeller cavity 180, respectively.

A pressure port 188 may be provided in the atomizer assembly block 179 of the atomizer assembly 178. The pressure port 188 may open to the blower tube interior 57 of the blower tube 56 at the upstream surface of the atomizer assembly block 179. At least one pressure port fluid passage 185 may extend into the atomizer assembly block 179. The pressure port fluid passage 185 may be disposed in fluid communication with the fluid tank interior 173 of the fluid tank 171 and with the pressure port 188. At least one tank pressure valve opening 186 may extend into the atomizer assembly block 179. The tank pressure valve opening 186 may be disposed in fluid communication with and between the pressure port fluid passage 185 and the pressure port 188. A tank pressure valve 194 may be threaded into the tank pressure valve opening 186. Accordingly, the tank pressure valve 194 can be bidirectionally threaded in the tank pressure valve opening 186 to vary the size or width of the communicative opening between the pressure port fluid passage 185 and the pressure port 188 to bleed off a selected quantity of the liquid 42 from the fluid tank interior 173 of the fluid tank 171 into the blower tube interior 57 of the blower tube 56 to correspondingly control the pressure of the liquid 42 as it flows from the fluid tank interior 173 of the fluid tank 171 through the fluid flow passage 181 into the interior passage 182 and through the impeller cavity 180. The rotational speed of the atomizing impeller 190 may thus be selectively increased or decreased by increasing or decreasing, respectively, the pressure of the liquid 42 by manipulation of the tank pressure valve 194.

In typical application of the fluid applicator assembly 170, a supply of the liquid 42 may be placed in the fluid tank interior 173 of the fluid tank 171. In some embodiments, this may be accomplished by removing the fill neck cap 175 from the fill neck 174, pouring the liquid 42 into the fluid tank interior 173 through the fill neck 174 and replacing the fill neck cap 175 on the fill neck 174. The blowing apparatus 50 may be aimed at the target space and/or surface, as was heretofore described with respect to the apparatus 1 in FIG.

8, and operated to blow air 40 through the blower tube interior 57 to the blower tube discharge end 58 of the blower tube 56.

As the air 40 flows around the sides of the atomizer assembly block 179 of the atomizer assembly 178 and past the atomizer outlet port 184, the resulting pressure drop in the impeller cavity 180 may draw the liquid 42 from the fluid tank interior 173 of the fluid tank 171 through the fluid passage 181 and the interior passage 182, respectively, and into the impeller cavity 180 typically through the atomizing impeller port 183. The pressurized liquid 42 may rotate the atomizing impeller 190, which may in turn atomize the liquid 42 and eject the resulting atomized liquid droplets 46 through the atomizer outlet port 184 into the blower tube interior 57. The atomized liquid droplets 46 may be ejected from the blower tube discharge end 58 of the blower tube 56 and uniformly fill the target space and/or coat and dry on the target surface or surfaces, thus forming uniform dispersal of the liquid 42 in the target space and/or coverage of the liquid 42 on the target surface or surfaces.

Figure 15:
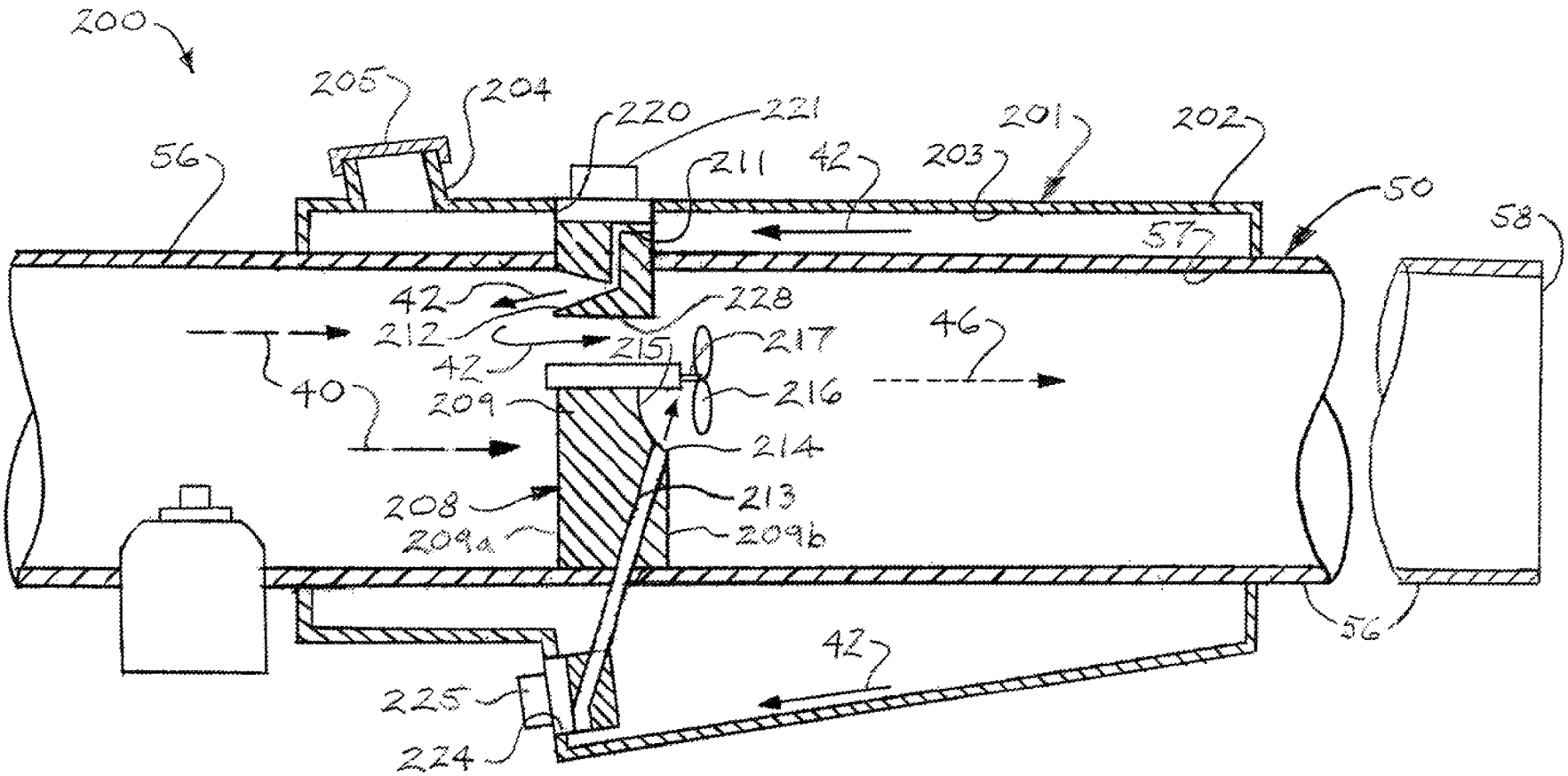
FIG. 15 is a sectional view of another alternative illustrative embodiment of the fluid applicator assemblies.

Referring next to FIG. 15 of the drawings, another alternative illustrative embodiment of the fluid applicator assemblies is generally indicated by reference numeral 200. The assembly 200 may be built into the blowing apparatus 50 and may include a fluid tank 201 having a fluid tank wall 202. A fluid tank interior 203 may be formed by and between the blower tube 56 and the fluid tank wall 202. The fluid tank interior 203 may encircle the blower tube 56 of the blowing apparatus 50. A fluid tank fill neck 204, closed by a removable fill neck cap 205, may extend from the fluid tank wall 202 to facilitate placement of the liquid 42 which is to be atomized into the fluid tank interior 203.

An atomizer assembly 208 may be disposed in the blower tube interior 57 of the blowing apparatus 50 and the fluid tank interior 203 of the fluid tank 201. The atomizer assembly 208 may facilitate contact between the liquid 42 to be atomized and the air 40 flowing through the blower tube interior 57 of the blower tube 56. In some embodiments, the atomizer assembly 208 may include an atomizer assembly block 209. The atomizer assembly block 209 may be sealingly mounted to the fluid tank wall 202 of the fluid tank 201 and the blower tube 56 of the blowing apparatus 50 according to the knowledge of those skilled in the art. The blower tube 56 of the blowing apparatus 50 and the fluid tank wall 202 of the fluid tank 201 may include slots or openings and suitable seals (not numbered) which are suitable for this purpose. The atomizer assembly block 209 may have an upstream surface 209*a* which faces the upstream portion (relative to the direction of flow of the air 40) of the blower tube interior 57 and a downstream surface 209*b* which faces the downstream portion of the blower tube interior 57.

At least one atomizing impeller 216 may be mounted at the downstream surface 209*b* of the atomizer assembly block 209. In some embodiments, the atomizing impeller 216 may be mounted on an impeller shaft 217 which extends from the atomizer assembly block 209.

At least one upstream fluid passage 211 may extend through the atomizer assembly block 209 of the atomizer assembly 208. At least one upstream fluid outlet port 212 may open to the upstream surface 209*a* of the atomizer assembly block 209 in fluid communication with the blower tube interior 57. The upstream fluid passage 211 may establish fluid communication between the fluid tank interior 203 of the fluid tank 201 and the blower tube interior 57 at the upstream fluid outlet port 212. At least one through passage 228 may extend through the atomizer assembly block 209 from the upstream surface 209*a* at the upstream fluid outlet port 212 to the downstream surface 209*b*. The through passage 228 may be disposed adjacent to the atomizing impeller 216.

At least one downstream fluid passage 213 may extend at least partially through the atomizer assembly block 209 of the atomizer assembly 208. At least one downstream fluid outlet port 214 may open to the downstream surface 209*b* of the atomizer assembly block 209 in fluid communication with the blower tube interior 57. The downstream fluid passage 213 may establish fluid communication between the fluid tank interior 203 of the fluid tank 201 and the blower tube interior 57 at the downstream fluid outlet port 214.

In some embodiments, a port cavity 215 may extend into the downstream surface 209*b* of the atomizer block assembly 209 typically behind or upstream with respect to the atomizing impeller 216. The downstream fluid outlet port 214 may open into the port cavity 215.

In some embodiments, an upstream port access opening 220 may extend through fluid tank wall 202 of the fluid tank 201. The upstream port access opening 220 may be disposed in communication with the upstream fluid passage 211. A removable port cap 221 may close the upstream port access opening 220. The port cap 221 may be removed from the upstream port access opening 220 to facilitate access to the upstream fluid passage 211 such as for the purpose of removing blockages in the upstream fluid passage 211 and/or for other purposes which may be deemed necessary.

A downstream port access opening 224 may extend through fluid tank wall 202 of the fluid tank 201. The downstream port access opening 224 may be disposed in communication with the downstream fluid passage 213. A removable port cap 225 may open the downstream port access opening 224. The port cap 225 may be removed from the downstream port access opening 224 such as for the purpose of removing blockages in the downstream fluid passage 213 and/or for other purposes which may be deemed necessary.

In typical application of the apparatus 200, a supply of the liquid 42 may be placed in the fluid tank interior 203 of the fluid tank 201 such as by removing the fill neck cap 205 from the fill neck 204 and pouring the liquid 42 into the fluid tank interior 203 through the fill neck 204. The blowing apparatus 50 may be aimed at the target space and/or surface, as was heretofore described with respect to the apparatus 1 in FIG. 8. The blowing apparatus 50 may be operated to blow air 40 through the blower tube interior 57 to the blower tube discharge end 58 of the blower tube 56.

As the air 40 flows past the upstream fluid outlet port 212 in the upstream surface 209*a* and through the through passage 228 in the atomizer assembly block 209 of the atomizer assembly 208, the resulting pressure drop at the upstream fluid outlet port 212 may draw the liquid 42 from the fluid tank interior 203 of the fluid tank 201 through the upstream fluid passage 211 and into the blower tube interior 57 through the upstream fluid outlet port 212. The liquid 42 may travel with the flowing air 40 through the through passage 228 and contact and rotate the atomizing impeller 216, which may atomize the liquid 42 and eject the resulting atomized liquid droplets 46 from the blower tube discharge end 58 of the blower tube 56.

Simultaneously, the rotating atomizing impeller 216 may create a pressure drop at the downstream fluid outlet port 214 in the port cavity 215 and through the downstream fluid passage 213. This pressure drop may draw the liquid 42 from the fluid tank interior 203 through the downstream fluid passage 213 and from the downstream fluid outlet port 214. The atomizing impeller 216 may atomize the liquid 42 and eject the resulting atomized liquid droplets 46 from the blower tube discharge end 58 of the blower tube 56. The atomized liquid droplets 46 may uniformly fill the target space and/or coat and dry on the target surface or surfaces, thus facilitating uniform dispersal of the liquid 42 in the target space and/or coverage of the liquid 42 on the target surface or surfaces.

Referring next to FIGS. 16-19 of the drawings, an alternative illustrative embodiment of the fluid applicator assemblies is generally indicated by reference numeral 301. In the fluid applicator assembly 301, elements which are analogous to the respective elements of the fluid applicator assembly 1 that was heretofore described with respect to FIGS. 1-12 are designated by the same respective numerals in the 301-399 series in FIGS. 16-19.

Figure 19:
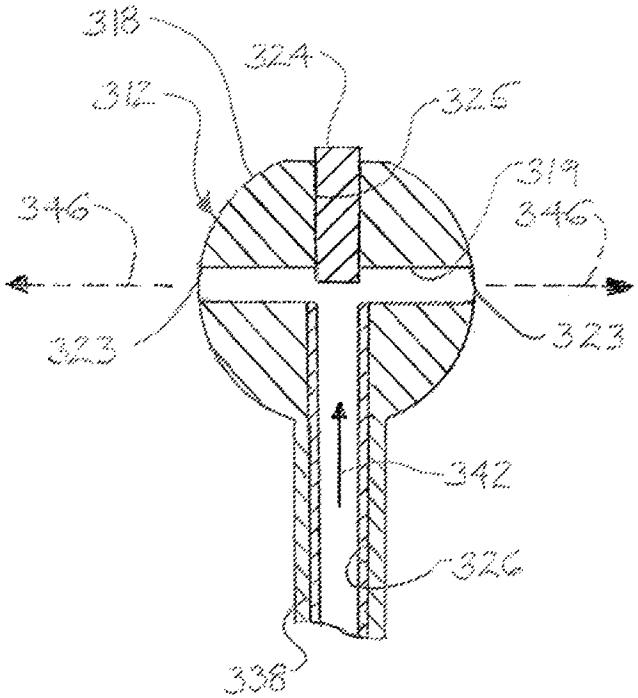
FIG. 19 is a sectional view, taken along section lines 19-19 in FIG. 16.
Figure 18:
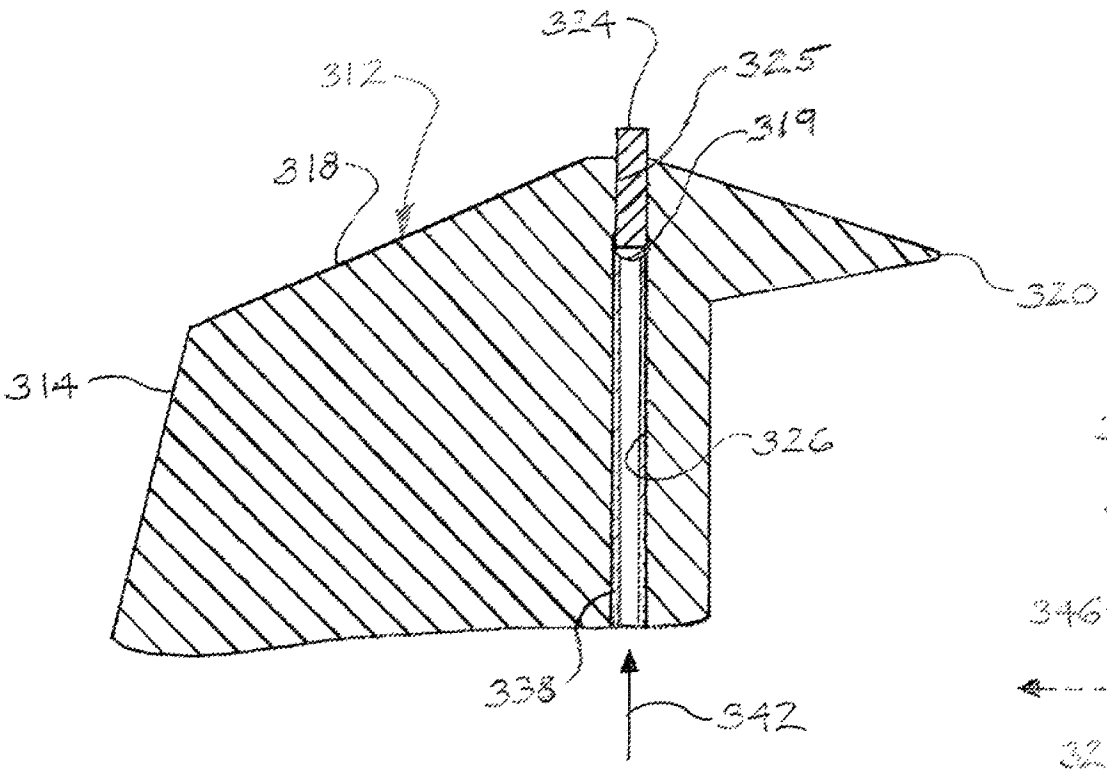
FIG. 18 is an enlarged sectional view, taken along section lines 18-18 in FIG. 17, of the fluid ejection portion of the fluid applicator assembly, more particularly illustrating typical flow of liquid through the through passage to the fluid ejection passage in the fluid ejection portion.

The fluid ejection conduit of the fluid applicator assembly 301 may include a fluid ejection passage 319 which is disposed in fluid communication with the tube opening 326 (FIGS. 18 and 19) and extends laterally through the fluid ejection head 318 of the fluid ejection portion 312, typically at or forwardly of the major width or diameter of the fluid ejection head 118. A pair of fluid ejection openings 323 may terminate the respective ends of the fluid ejection passage 319. The fluid ejection openings 323 may open to the respective side surfaces of the fluid ejection head 318. As illustrated in FIGS. 18 and 19, the adjuster screw opening 325 and the tube opening 326 may communicate with the fluid ejection passage 319 typically substantially equidistant between the fluid ejection openings 323. Accordingly, as illustrated in FIG. 19 the fluid ejection passage 319 may intersect and form the junction between the adjuster screw opening 325 and the tube opening 326.

Application of the fluid applicator assembly 101 may be as was heretofore described with respect to the fluid applicator assembly 1 in FIGS. 1-12. Accordingly, the typically tapered rear nozzle body end 305 of the nozzle body 303 may divide the stream of air 340 generated by the blowing apparatus 50 (FIG. 7) on which the fluid applicator assembly 101 is mounted into separate air streams which flow initially along the respective side nozzle body surfaces 304 of the nozzle body 303 and then into the respective air flow cavities 308 (FIG. 16) and the air inlet slot 309, respectively, of the nozzle 302. The air 340 may flow downwardly from the air inlet slot 309, through the container cap 330 and into the interior of the liquid container 336, respectively. The air 340 in the liquid container 336 may apply downward surface pressure against the liquid 342 such that a portion of the liquid 342 flows from the liquid container 336 upwardly through the liquid tubing 338, as illustrated in FIG. 18. The liquid 342 may discharge from the liquid tubing 338 in opposite directions into and through the liquid ejection passage 319 in the fluid ejection head 318.

Figure 17:
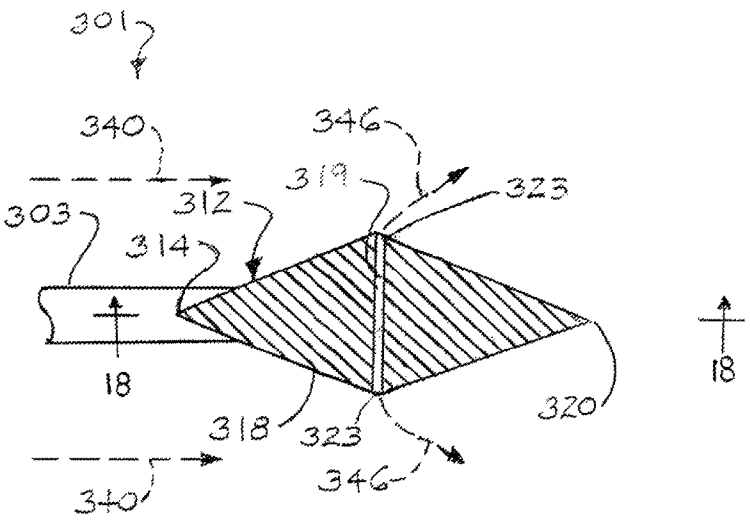
FIG. 17 is a sectional view, taken along section lines 17-17 in FIG. 16, of a typical fluid ejection portion of the illustrative fluid applicator assembly, more particularly illustrating ejection of atomized fluid droplets from a pair of fluid ejection openings in opposite sides of the fluid ejection portion.
Figure 16:
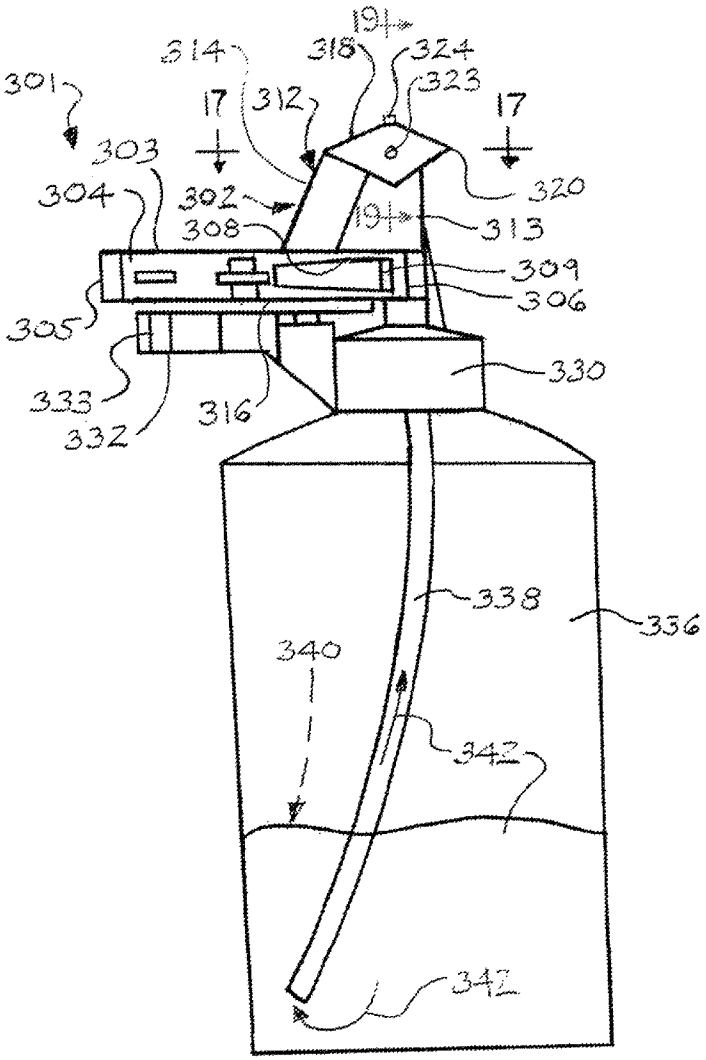
FIG. 16 is a side view of an alternative illustrative embodiment of the fluid applicator assemblies with a supply of liquid in the liquid container of the assembly.

As illustrated in FIG. 17, a second portion of the flowing air 340 may bypass the air flow cavities 308 and flow past the fluid ejection portion 312 of the nozzle 302. Accordingly, the typically tapered rear edge 314 of the ejection head support 313 may divide the second portion of the air 340 into separate air streams which flow on opposite sides of the ejection head support 313 and fluid ejection head 318, typically as illustrated in FIG. 17. The flowing air 340 may create negative pressure which aspirates and pulls or ejects the liquid 342 from the fluid ejection passage 319 in the fluid ejection head 318. As it is ejected from the fluid ejection openings 323 in the opposite sides of the fluid ejection head 318, as illustrated in FIGS. 17 and 19, the liquid 342 is atomized. The atomized liquid droplets 346 may travel with the flowing air 340 into the target space or onto or against the target surfaces toward which the blowing apparatus 50 (FIG. 7) on which the fluid applicator assembly 101 is mounted is aimed. The atomized liquid droplets 346 may uniformly fill the target space and/or coat and dry on the target surface or surfaces, thus forming uniform dispersal of the liquid 342 in the target space and/or coverage of the liquid 342 on the target surface or surfaces.

While certain illustrative embodiments of the disclosure have been described above, it will be recognized and understood that various modifications can be made to the embodiments and the appended claims are intended to cover all such modifications which may fall within the spirit and scope of the disclosure.

What is claimed is:

1. A fluid applicator assembly configured for mounting on a blower tube on a blowing apparatus to atomize a liquid and eject the atomized liquid, comprising:

a nozzle including:

a nozzle body comprising a rear nozzle body end, a front nozzle body end and a pair of opposite side nozzle body surfaces extending from the rear nozzle body end to the front nozzle body end, the side nozzle body surfaces tapering and joining at the rear nozzle body end;

at least one air flow cavity in the nozzle body, the at least one air flow cavity extending into at least one of the pair of opposite side nozzle body surfaces of the nozzle body;

an air inlet slot extending through the nozzle body and disposed in fluid communication with the at least one air flow cavity;

a fluid ejection portion carried by the nozzle body, the fluid ejection portion including:

an ejection head support extending from the nozzle body;

a fluid ejection head carried by the ejection head support;

a tube opening extending through the fluid ejection portion; and a fluid ejection conduit in the fluid ejection head and disposed in fluid communication with the tube opening; and a liquid container disposed in fluid communication with the fluid ejection conduit through the tube opening, the liquid container configured to contain a supply of the liquid to be atomized.

2. The fluid applicator assembly of claim 1 wherein the fluid ejection conduit comprises a fluid ejection slot.

3. The fluid applicator assembly of claim 1 wherein the fluid ejection conduit comprises fluid ejection passage and at least one fluid ejection opening terminating the fluid ejection passage.

4. The fluid applicator assembly of claim 3 wherein the fluid ejection conduit extends laterally through the fluid ejection head, and the at least one fluid ejection opening comprises a pair of fluid ejection openings terminating opposite ends of the fluid ejection conduit.

5. A fluid applicator assembly configured for mounting on a blower tube on a blowing apparatus to atomize a liquid and eject the atomized liquid, comprising:

a nozzle including:

a nozzle body;

at least one air flow cavity in the nozzle body;

an air inlet slot extending through the nozzle body and disposed in fluid communication with the at least one air flow cavity;

a fluid ejection portion carried by the nozzle body, the fluid ejection portion including:

an ejection head support extending from the nozzle body;

a fluid ejection head carried by the ejection head support;

a tube opening extending through the fluid ejection portion; and a fluid ejection conduit in the fluid ejection head and disposed in fluid communication with the tube opening; and a liquid container disposed in fluid communication with the fluid ejection conduit through the lube opening, the liquid container configured to contain a supply of the liquid to be atomized; and an adjuster screw opening in the fluid ejection head and disposed in fluid communication with the fluid ejection conduit and a spray control adjuster screw threadably disposed in the adjuster screw opening.

6. A fluid applicator assembly configured for mounting on a blower tube on a blowing apparatus to atomize a liquid and eject the atomized liquid, comprising:

a nozzle including;

a nozzle body;

at least one air flow cavity in the nozzle body;

an air inlet slot extending through the nozzle body and disposed in fluid communication with the at least one air flow cavity;

a fluid ejection portion carried by the nozzle body, the fluid ejection portion including:

an ejection head support extending from the nozzle body;

a fluid ejection head carried by the ejection head support;

a tube opening extending through the fluid ejection portion; and a fluid ejection conduit in the fluid ejection head and disposed in fluid communication with the tube opening; and a liquid container disposed in fluid communication with the fluid ejection conduit through the tube opening, the liquid container configured to contain a supply of the liquid to be atomized; and wherein the ejection head support comprises a sloped or angled and tapered rear edge.

7. A fluid applicator assembly configured for mounting on a blower tube on a blowing apparatus to atomize a liquid and eject the atomized liquid, comprising:

a nozzle including:

a nozzle body;

at least one air flow cavity in the nozzle body;

an air inlet slot extending through the nozzle body and disposed in fluid communication with the at least one air flow cavity;

a fluid ejection portion carried by the nozzle body, the fluid ejection portion including:

an ejection head support extending from the nozzle body;

a fluid ejection head carried by the ejection head support;

a tube opening extending through the fluid ejection portion; and a fluid ejection conduit in the fluid ejection head and disposed in fluid communication with the tube opening; and a liquid container disposed in fluid communication with the fluid ejection conduit through the tube opening, the liquid container configured to contain a supply of the liquid to be atomized; and at least one nozzle mount flange extending in parallel, spaced-apart relationship to the nozzle body and a blower tube slot between the at least one nozzle mount flange and the nozzle body, the at least one nozzle mount flange configured to facilitate attachment of the nozzle to the blower tube of the blowing apparatus.

8. A fluid applicator assembly configured for mounting on a blower tube on a blowing apparatus to atomize a liquid and eject the atomized liquid, comprising:

a nozzle including:

a nozzle body comprising a rear nozzle body end, front nozzle body end and a pair of opposite side nozzle body surfaces extending from the rear nozzle body end to the front nozzle body end, the side nozzle body surfaces tapering and joining at the rear nozzle body end;

at least one air flow cavity in the nozzle body, the at least one air flow cavity extending into at leas one of the pair of opposite side nozzle body surfaces of the nozzle body;

an air inlet slot extending through the nozzle body and disposed in fluid communication with the at least one air flow cavity;

a fluid ejection portion carried by the nozzle body, the fluid ejection portion including:

an ejection head support extending from the nozzle body:

a fluid ejection head carried by the ejection head support;

a tube opening extending through the fluid ejection portion;

a fluid ejection conduit in the fluid ejection head and disposed in fluid communication with the tube opening; and a container cap extending from the fluid ejection head of the fluid ejection portion; and a liquid container carried by the container cap and disposed in fluid communication with the fluid ejection conduit through the tube opening, the liquid container configured to contain a supply of the liquid to be atomized.

9. The fluid applicator assembly of claim 8 wherein the fluid ejection conduit comprises a fluid ejection slot.

10. The fluid applicator assembly of claim 8 wherein the fluid ejection conduit comprises fluid ejection passage and at least one fluid ejection opening terminating the fluid ejection passage.

11. The fluid applicator assembly of claim 10 wherein the fluid ejection conduit extends laterally through the fluid ejection head, and the at least one fluid ejection opening comprises a pair of fluid ejection openings terminating opposite ends of the fluid ejection conduit.

12. The fluid applicator assembly of claim 8 further comprising an adjuster screw opening in the fluid ejection head and disposed in fluid communication with the fluid ejection conduit and a spray control adjuster screw threadably disposed in the adjuster screw opening.

13. The fluid applicator assembly of claim 8 wherein the ejection head support comprises a sloped or angled and tapered rear edge.

14. The fluid applicator assembly of claim 8 further comprising at least one nozzle mount flange extending in parallel, spaced-apart relationship to the nozzle body and a blower tube slot between the at least one nozzle mount flange and the nozzle body, the at least one nozzle mount flange configured to facilitate attachment of the nozzle to the blower tube of the blowing apparatus.

* * * * *